US010251228B1

(12) United States Patent
Lester

(10) Patent No.: US 10,251,228 B1
(45) Date of Patent: Apr. 2, 2019

(54) LED DIMMING STABILIZER APPARATUS AND METHOD

(71) Applicant: Marshall Lester, Northridge, CA (US)

(72) Inventor: Marshall Lester, Northridge, CA (US)

( * ) Notice: Subject to any disclaimer, the term of this patent is extended or adjusted under 35 U.S.C. 154(b) by 0 days.

(21) Appl. No.: 15/588,666

(22) Filed: May 7, 2017

(51) Int. Cl.
*H05B 33/08* (2006.01)

(52) U.S. Cl.
CPC ..... *H05B 33/0827* (2013.01); *H05B 33/0845* (2013.01)

(58) Field of Classification Search
CPC combination set(s) only.
See application file for complete search history.

(56) References Cited

U.S. PATENT DOCUMENTS

2012/0235582 A1* 9/2012 Ido ..... H05B 33/0815 315/186

* cited by examiner

*Primary Examiner* — Douglas W Owens
*Assistant Examiner* — Jianzi Chen

(57) ABSTRACT

An add-on electronic load that, when inserted in parallel with a LED fixture, which is controlled by a triac-based dimmer, will improve dimming performance by reducing flickering and/or achieving a lower stable dim level, while dissipating an amount of power that can be safely dissipated if said add-on load in installed in a single-gang wall box behind installed said dimmer.

12 Claims, 13 Drawing Sheets

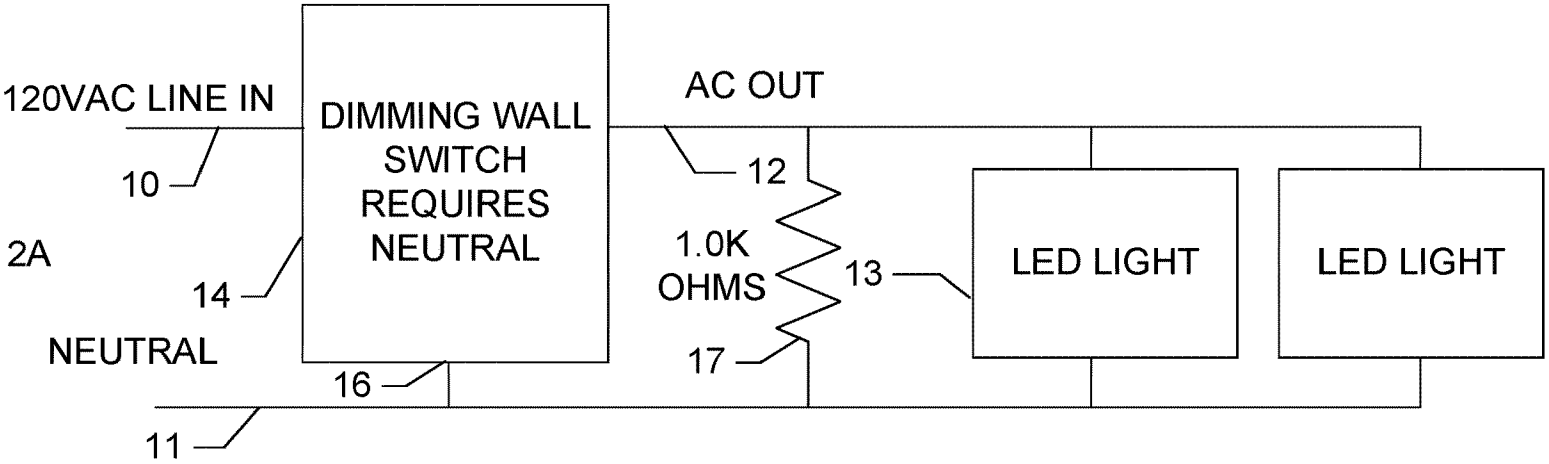
FIG. 2A
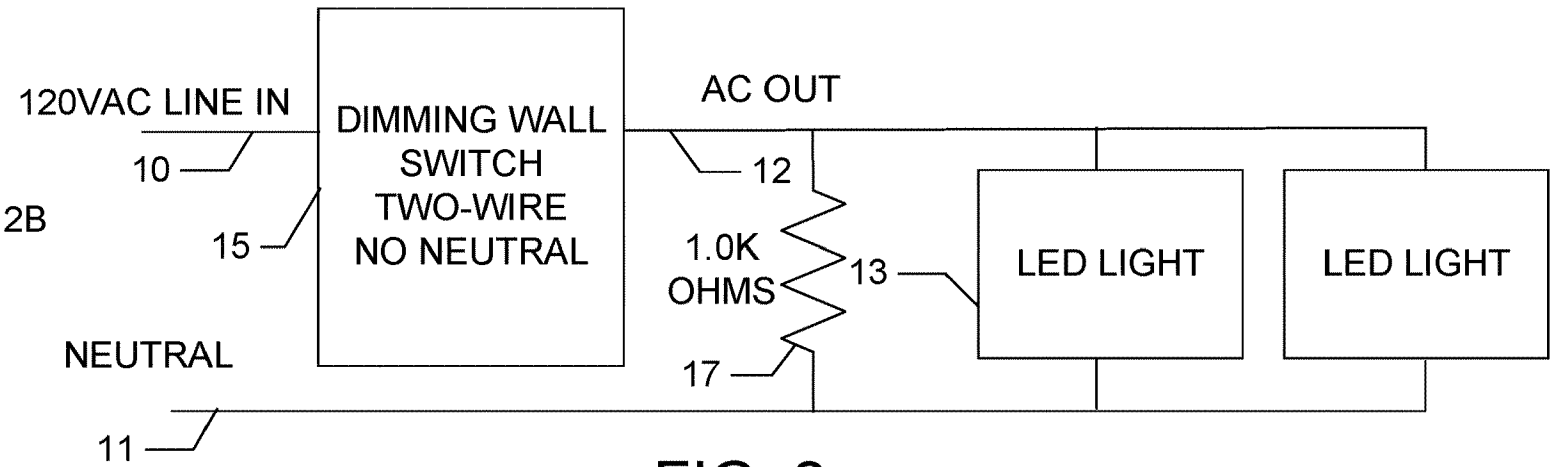
FIG. 2B
FIG. 2

FIG. 5A 90% ON

FIG. 5B LOAD RESISTOR ON 100%

FIG. 5C VOLTAGE ACROSS LOAD RESISTOR

FIG. 6A 90% ON

FIG. 6B LOAD RESISTOR ON 50%

FIG. 6C VOLTAGE ACROSS LOAD RESISTOR

FIG. 7A 90% ON

FIG. 7B LOAD RESISTOR ON 50%

FIG. 7C VOLTAGE ACROSS LOAD RESISTOR

FIG. 13A 90% ON

FIG. 13B LOAD RESISTOR ON 100%

FIG. 13C VOLTAGE ACROSS LOAD RESISTOR

LED DIMMING STABILIZER APPARATUS AND METHOD

CROSS REFERENCE TO RELATED APPLICATION

This application claims the benefit of provisional patent application No. 62/333,244 filed May 8, 2016 by the present inventor.

FEDERALLY SPONSORED RESEARCH

Not Applicable

SEQUENCE LISTING OR PROGRAM

Not Applicable

FIELD OF INVENTION

The invention relates generally to an apparatus which improved dimming of LED fixtures and bulbs.

BACKGROUND

In recent years the use of LED fixtures and bulbs to replace incandescent bulbs has become widespread. Most modern LED bulbs and fixtures make the claim that they are dimmable, using conventional triac-based dimmers.

A variety of problems arise when using triac-based dimmers to dim LED fixtures.

They will not dim to low levels as incandescent bulbs will.

They may flicker unacceptably especially at lower levels.

They may not turn off all the way.

They may stay on 100% and not dim at all.

All of these problems relate to the fact that the conventional triac-based dimming circuit is designed to dim a relatively large resistive load, like an incandescent light bulb. Most 600 W wall dimmers have a specified minimum load that is typically 60 watts.

LED lights use a type of switching power supply that is very different that a resistive load. There are also many different types of LED fixtures that use power supplies that are very different. It is impossible for any dimmer manufacturer to design a dimmer that will work with all LEDs. It is impossible for a LED manufacturer to design a dimmable LED fixture that will work with all dimmers. If a homeowner or electrical contractor chooses a specific LED fixture and specific wall dimmer that is always some possibility the combination will have one or more of the problems listed above.

It is commonly known that adding an additional light bulb in parallel with the LED fixture may improve the dimming and may eliminate or reduce some of the problems listed above.

There are problems with this solution. We have discovered that the lower the impedance of the added load the more the load reduces the dimming problems. For 120 VAC fixtures a load of 10K helps marginally. A load of 5K ohms helps a little more. A load of 1K ohms helps greatly. The problem with lower impedance loads is that the power dissipated when the dimmer is on to a high level is too great. A 100% dim level a 10K load will consume 1.44 W, and a 5K load will consume 2.88 W, and 2K will consume 7.2 W and 1.0K will consume 14.4 W.

The most straightforward inexpensive place to install the load resistor is behind the dimmer switch in the single gang box.

A 600 W triac-based dimmer will dissipate 5 W in a single-gang US electrical box at full load. Adding a load resistor to stabilize the LED dimming in the switch box behind the switch is the best solution. Adding a 2 Watt load is OK since 2.0 W in addition to the maximum 5 W dissipated by the dimming switch is acceptable. Adding a more than 2.5 watts is NOT acceptable because more than 2.5 Watts in addition to the maximum 5 W dissipated by the dimming switch is adding over 50% heat dissipation. And adding a 2K (7.2 watts) or 1K (14.4 watts) resistor is completely unacceptable and dangerous.

BACKGROUND OF THE INVENTION

Objects and Advantages

Accordingly, several objects and advantages of the present invention are:

to provide an add-on load that, when inserted in parallel with a LED fixture, powered by a triac-based dimmer, will improve dimming performance by reducing flickering and/or achieving a lower stable dim level, while dissipating an amount of power that can be safely dissipated if said add-on load in installed in a single-gang wall box behind installed said dimmer.

The add-on load will dissipate no more than 2 watts under worst-case conditions, so that it can be installed in the same electrical box as the dimmer switch without having to de-rate the dimmer switch.

The circuitry of the add-on load circuitry should effectively the stabilizing resistive load primarily when it is needed to insure stable operation and firing of the dimming triac circuit in the dimmer.

One advantage on the invention is that a contractor that discovers a dimming issue after replacing incandescent bulb fixtures with LED fixtures may have a simple fast inexpensive solution to the problem without going to a store and purchasing and testing a different dimmer switch or different LED fixtures. The other solutions are to replace the dimmer switch or replace the LED fixtures.

One other advantage is that this device can be manufactured and sold at a very low cost relative to the cost of a LED dimmer switch, the LED fixtures, or the labor cost to replace either the fixtures or LED dimmer switch.

Another advantage is the resistive load device will allow the LED dimmer to dim to a lower level in a stable non-flickering manner. In many installations it is very important to the customer that the dim level be low or very low depending on the application. If the customer demands a certain dim level, say 5%, and the dimmer/fixture combination can only produce a minimum level of 20%, then the contractor must make expensive and time consuming changes in order to meet the customers' demands. The cost of a purchasing and installing a different LED dimmer switch, different LED fixtures, or both can be very high. The cost can easily be in the multi-$100 range. If the load device which is the subject of the application can be installed for less than $20 it is a clear win-win for the contractor and customer.

SUMMARY

In order to aid in the understanding of this invention, it can be stated in essentially summary form that it is directed a specialized smart resistive load device designed to be inserted in parallel with a LED LIGHT bulb or fixture controlled by triac-based dimmer in order to improve the ability for the dimmer to dim the light output of the LED.

There are several embodiments of this invention that can be used that are covered in the application:

Inserting the resistive load on a periodic basis only during the parts of the AC cycle when it is needed to stabilize the triac turning on and off correctly. More specifically there are sections of the AC waveform near zero crossing where the AC voltage are very low compared to the peak voltage which if 160V.

Inserting the resistive load 100% of the time but only when the overall dimmer dim level is low enough to need the load to stabilize the triac turning on and off correctly. This is typically when the dimmer is below 50%.

Inserting a resistive load with some form of PWM with constant or varying duty cycles.

Inserting the resistive load using a combination of these different variations.

The solution which is the subject of this application is a novel load device that inserts a low impedance resistive load to the dimmer LED circuit but inserts the load ONLY during the part of the AC cycle or at the LED dim levels when it is needed. The solution may use a combination of some or all the embodiments of this invention. These different means of reducing the maximum power dissipation all can improve the dimming of the LED significantly.

It is important to understand the difference of the different methods.

Method #1: Inserting the load only during the parts of the AC cycle when it is needed to stabilize the triac turning on and off correctly. More specifically there are sections of the AC waveform near zero crossing where the AC voltage are very low compared to the peak voltage which if 160V. The triac triggers correctly at higher voltages such as 40V~160V, but not at voltages such as 10~40V. This method would turn on the additional load but only when the AC voltage is below some threshold such as 30V or 40V. This controlling of the insertion of the load would occur every cycle continuously very quickly. The load is removed and inserted one time every AC cycle. The power dissipated in the load is greatly reduced because the load is inserted for only a limited time and this time is only at lower voltage levels. Using this method a 1.0K ohm load may be inserted for a few msec before and after zero crossing and only dissipate about 1 W as opposed to the 14.4 W that would be consumed if inserted 100% of the cycle.

Method #2: Inserting the load only when the overall dimmer dim level is low enough to need the load to stabilize the triac turning on and off correctly. This method would monitor the overall average dim level produced by the dimmer to the LED and cause the insertion of the additional stabilizing load only when the average dim level was below a certain level, such as 30% or 40%. In this method the load is inserted or removed 100% of the time not on a cycle-by-cycle basis. If the dimmer is set to some level below the threshold the load is inserted and if the dimmer is set to a level above the threshold the load is removed. Using this method a 5.0K ohm load may be inserted if the dim level is below 30% and only dissipate about 0.9 W as opposed to the 2.88 W that would be consumed if inserted 100% of the cycle.

Method #3: A form of variable Pulse Width Modulation can be used to turn a load resistor on and off at some chosen frequency. This would be simple to do with the microprocessor circuit. The modulated turning of the load resistor can have two positive benefits. One benefit is that the overall power dissipated by the load resistor can be easily controlled by varying the duty cycle of the PWM. And two, the stabilizing effect can be increased by keeping the triac in the dimmer correctly trigged by re-triggering it so quickly that any short turn-off periods will be invisible to the human eye. The average power dissipated by the load resistor can be much lower that if it was connected to the dimmer 100% of the time.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein:

FIG. 2 DIMMERS AND LED LOADS WITH LOAD RESISTOR This figure shows the wiring diagram of any typical wall box dimmer connected to two LED lights with a LED stabilizing load resistor inserted. One figure shows the dimmer that requires a neutral and the other shows a dimmer that does not require a neutral.

Reference symbols or names are used in the Figures to indicate certain components, aspects or features shown therein. Reference symbols common to more than one Figure indicate like components, aspects or features shown therein.

DETAILED DESCRIPTION

In accordance with embodiments described herein the purpose of the apparatus of this invention as shown in FIGS. 1 to 13 is to enable the improved dimming of LED lights by conventional triac-based dimmers.

Figure 1:
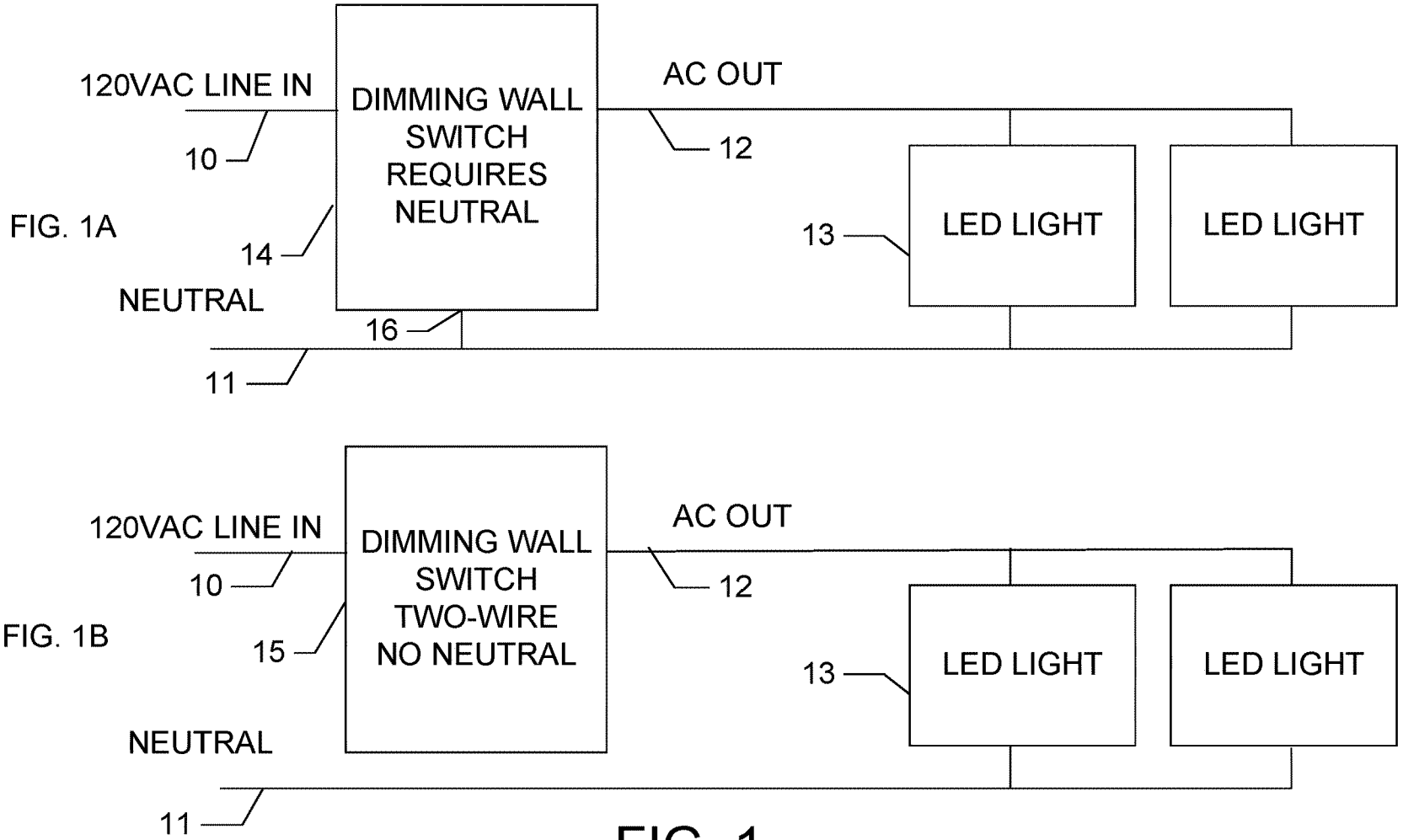
FIG. 1 DIMMERS AND LED LOADS This figure shows the wiring diagram of any typical wall box dimmer connected to two LED lights. One figure shows the dimmer that requires a neutral and the other shows a dimmer that does not require a neutral.

FIG. 1 shows a wiring diagram of conventional wall-box dimmers 14 and 15 and LED 11 lights. The dimmer 14 are fed power, line 10 and neutral 11, from a conventional 120V source. This source could be other voltages and frequencies such as 230 VAC and 50 HZ. The output wire 12 of the dimmers to the LED fixtures 12 is shown. The first dimmer 14 is the type that requires a neutral connection 16 and the second dimmer 15 is the type known as two-wire that does not require a neutral.

FIG. 2 shows the same components and wiring as FIG. 1 except for the addition of load resistors 17 wired in parallel with the LED lighting loads 13. This added resistive load 17 is often used to add some resistive loading to the dimmer output circuit to help stabilize the circuits operation to make the LED dimming function correctly. The loading of the LED drivers alone often is not similar to a resistive load. All dimmers 14, 15 are designed to function correctly with resistive loads, like an incandescent light bulb. A 1.0K resistor 17 powered with 120 VAC would consume and dissipate 14.4 watts at 120 VAC, but 14 watts is for too much power to dissipate in a single in a single gang wall box with a dimmer switch.

Figure 3:
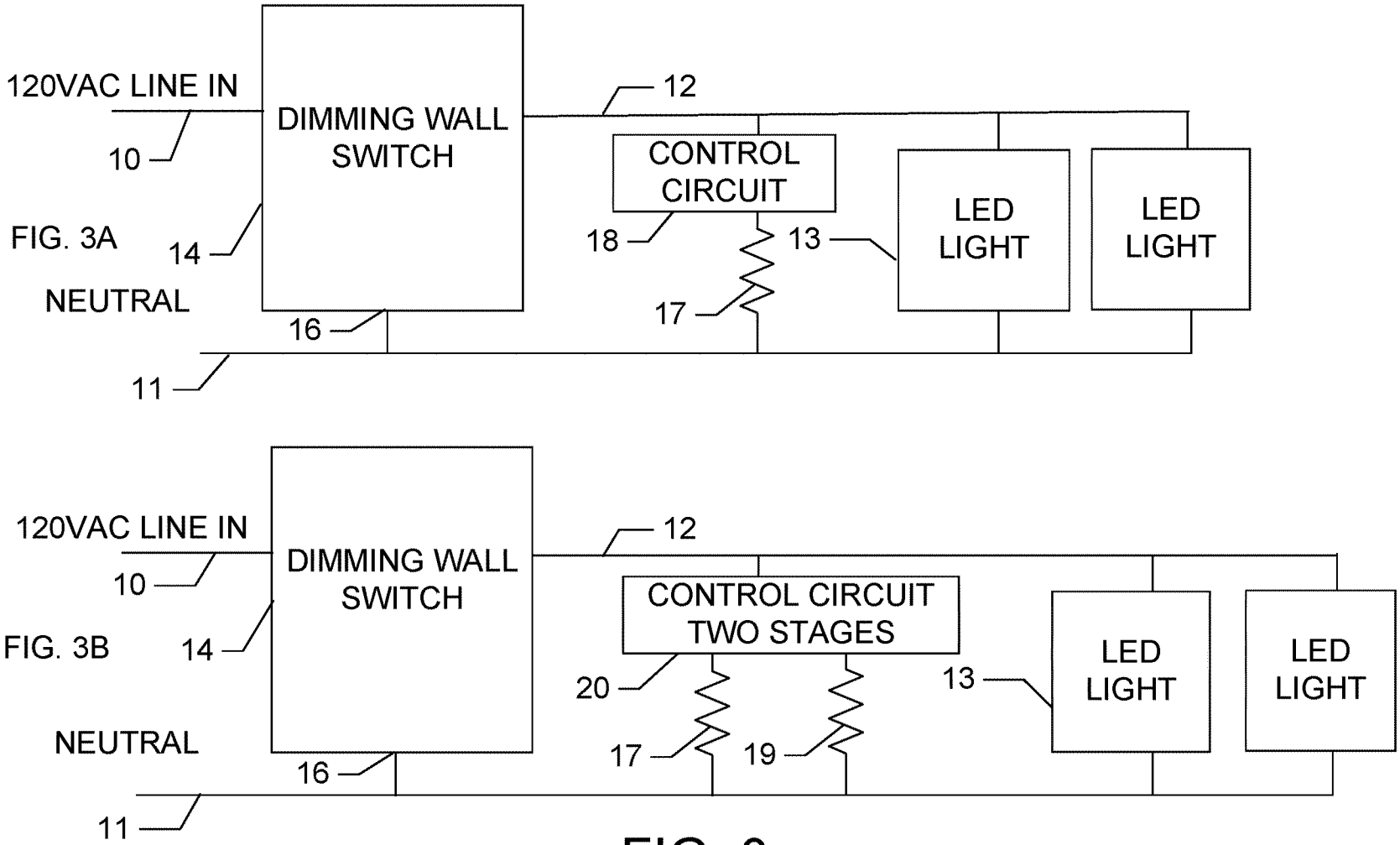
FIG. 3 DIMMERS AND LED LOADS WITH LOAD RESISTOR AND CONTROL FOR LOAD RESISTOR This figure shows the wiring diagram of any typical wall box dimmer connected to two LED lights with a LED stabilizing load resistor inserted. One figure shows the dimmer that requires a neutral and the other shows a dimmer that does not require a neutral.

FIG. 3 shows the same components and wiring as FIG. 2 except for the addition of control circuits 18, 20 in series with the load resistors 17, 19 wired in parallel with the LED lighting loads 13. This added control circuit is capable of determining when the resistive load is turned on and when it is turned off. There are several possible schemes covered in this description of the various modes of the control circuits 18, 20 turning on and off the load resistors 17, 19.

Figure 4:
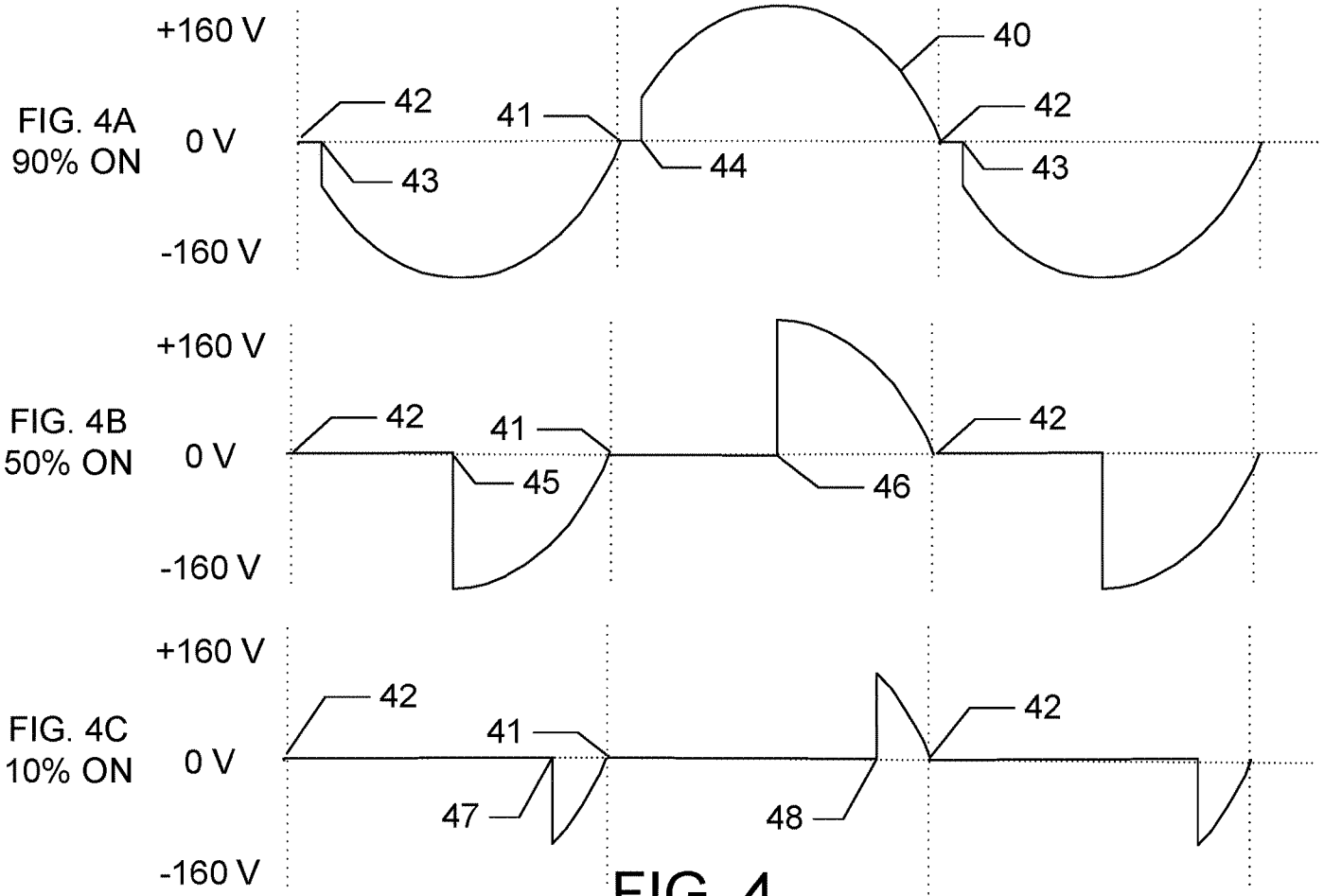
FIG. 4 DIMMING WAVEFORM. This figure shows the diagram a conventional triac-based dimming waveform. The three diagrams show the triac-based dimmer set to 90%, 50% and 10%.

In FIG. 4 we show three conventional triac-based dimming AC waveforms with FIG. 4A at 90% brightness, FIG. 4B at 50% brightness and FIG. 4C at 10% brightness. The AC zero crossing points are shown at the rising zero crossing at 41 and the falling zero crossing at 42. The six triac trigger points are shown at 43, 44, for 90% on, 45, 46, for 50% on 47, and 48 for 10% on respectively.

Figure 5:
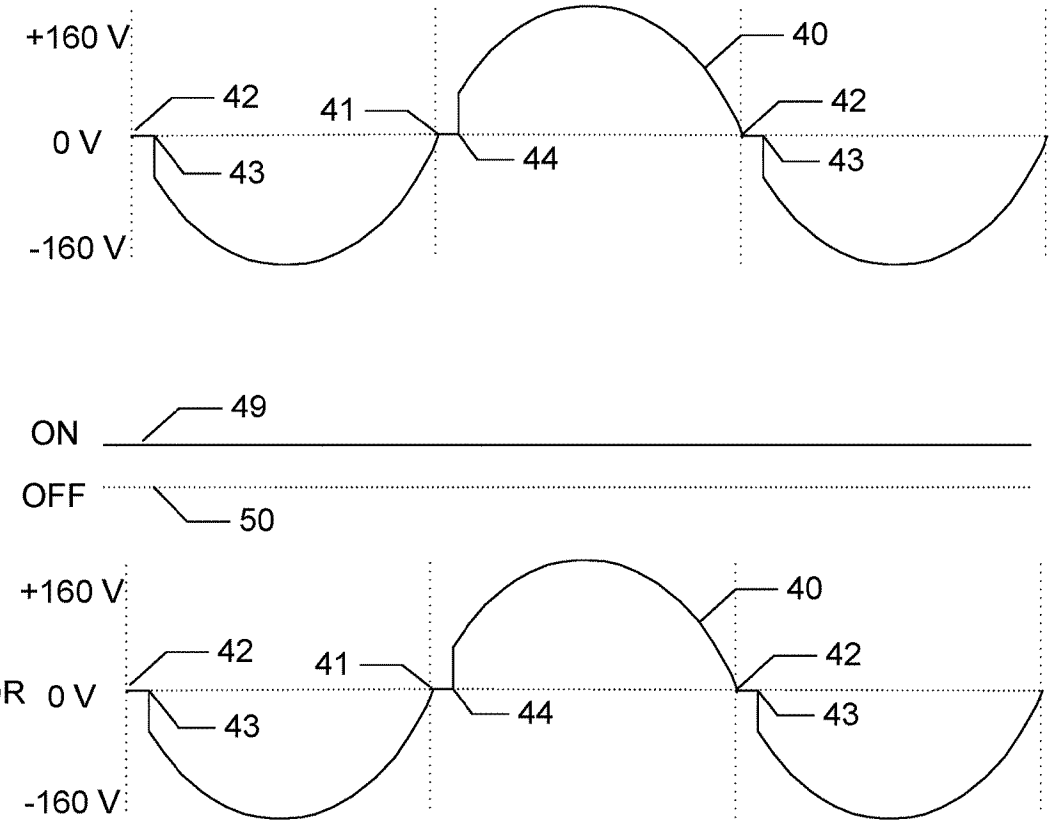
FIG. 5 LOAD RESISTOR ON 100% ALL CYCLE. This figure shows the diagram a conventional triac-based dimming waveform with the dimmer set to 90%. This figure also shows the voltage waveform that would be imposed across a fixed simple load resistor such as the one shown in FIG. 2. This figure also shows the power that would be dissipated across a fixed simple load resistor such as the one shown in FIG. 2, in this example 14.4 watts.
Figure 6:
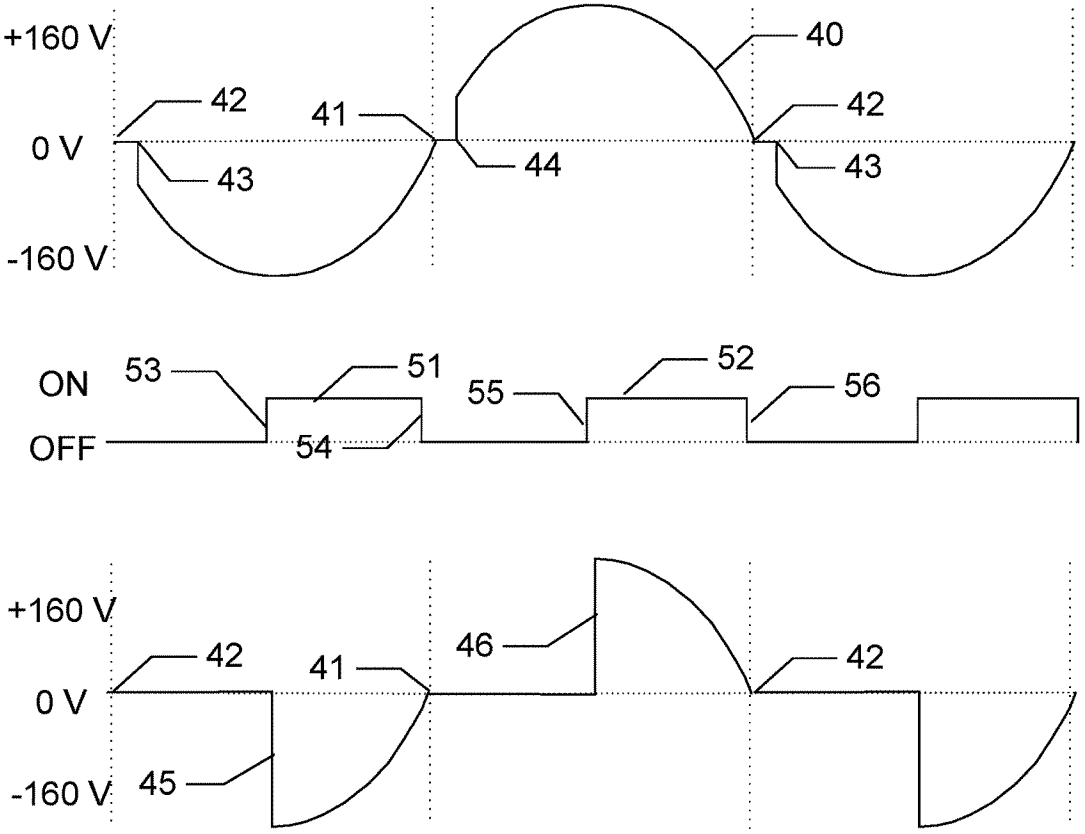
FIG. 6 LOAD RESISTOR ON AT FIXED TIME IN MIDDLE OF CYCLE. This figure shows the diagram a conventional triac-based dimming waveform with the dimmer set to 90% but the load resistor is only inserted at the 50% dimming time point. This figure also shows the voltage waveform that would be imposed across a fixed simple load resistor such as the one shown in FIG. 2. This figure also shows the power that would be dissipated across a fixed simple load resistor such as the one shown in FIG. 2, in this example 7.2 watts.
Figure 7:
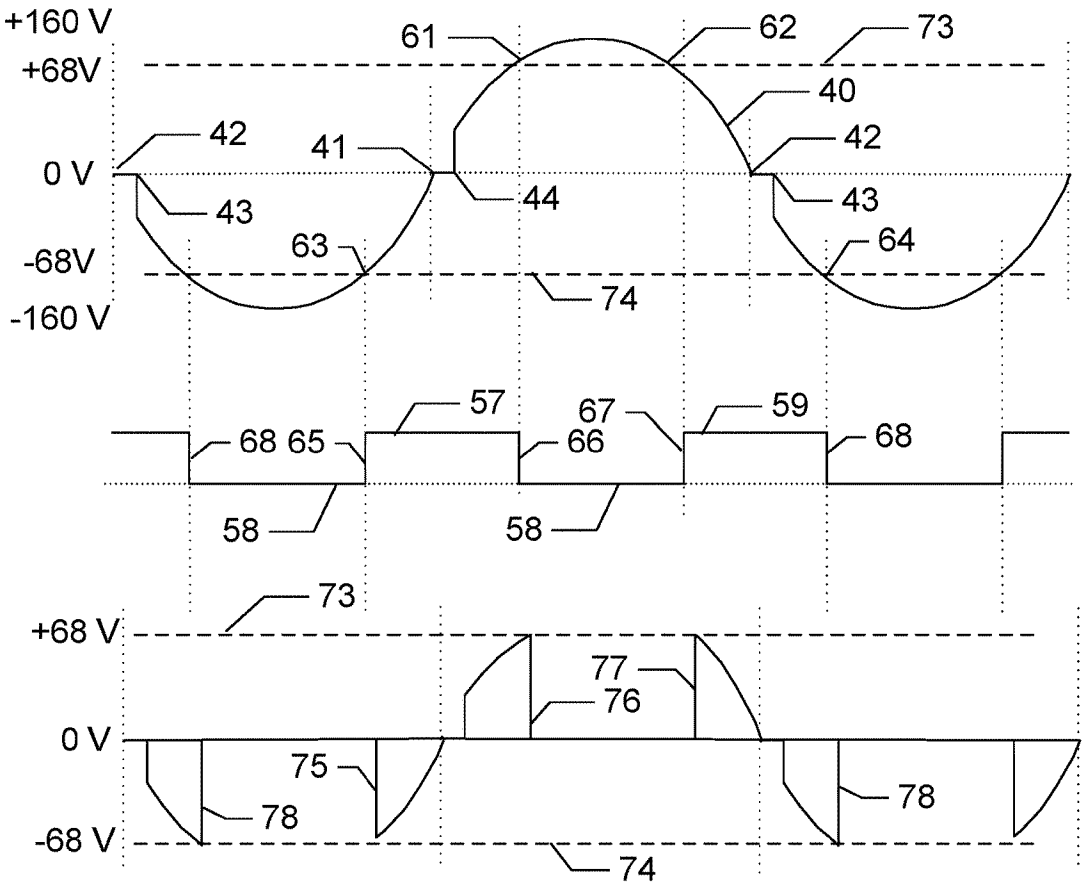
FIG. 7 LOAD RESISTOR ON AT FIXED TIME IN BEGINNING AND END OF CYCLE, ZERO CROSSING METHOD. This figure shows the diagram a conventional triac-based dimming waveform with the dimmer set to 90% but the load resistor is only inserted at the 10% dimming time point. This figure also shows the voltage waveform that would be imposed across a fixed simple load resistor such as the one shown in FIG. 2. This figure also shows the power that that would be dissipated across a fixed simple load resistor such as the one shown in FIG. 2, in this example 1.0 watts.

In FIG. 5 the waveform shown in 5A is the waveform coming out of the dimmer if the dimmer is on 90%. In FIG. 5A is shown a normal 90% ON AC waveform 40 coming from a dimmer. It shows the usual points of falling zero crossing 42, rising zero crossing, 41 triac turn-on points 43, 44. The waveform 5C that would appear across a simple 1K load resistor, 17 in FIG. 2, if the 1K load resistor was applied during the entire cycle, with no additional control. FIG. 5B is a graphical representation of a timing diagram of what the voltage across the load resistor 17 would be if installed as shown in FIG. 2 when the load resistor is connected in parallel with the LED fixtures, 13. In FIG. 5B it can be seen the load resistor is connected to the dimmer output 100% of the time 49. This is what would occur it the load resistor was connected as shown in FIG. 2, with no control circuit added. FIG. 5B is a graphical representation of a timing diagram of when the load resistor is connected to the circuit 49. Since the load resistor is always connected to the circuit the load resistor is 100% always present 49. The OFF state 50 is shown as a reference since the timing for the OFF state 50 will be modified in FIGS. 6 and 7. The normal waveform at 90% brightness is shown in 5A. Since there is no circuit to control the connection between the load wire 12 of the dimmer, to the load resistor 17, then the two waveforms 5A and 5C are the identical. A 1.0K resistor 17 powered with 120 VAC would consume and dissipate 14.4 watts at 120 VAC, but 14 watts is for too much power to dissipate in a single in a single gang wall box with a dimmer switch. This large load, 14 watts, is impractical and unsafe.

In FIG. 6A is shown a normal 90% ON AC waveform 40 coming from a dimmer. It shows the usual points of falling zero crossing 42, rising zero crossing, 41 triac turn-on points 43, 44. In FIG. 6C is shown the AC waveform 6C that would appear across a simple load resistor 17 if the load resistor was connected by a control circuit 18 to the dimmer load line 12 during only the last half 51, 52 of each AC power cycle. On the negative AC cycle the resistor ON time 51 is shown between points 53 and 54. On the positive AC cycle the resistor ON time 52 is shown between points 55 and 56. The normal waveform at 90% brightness is shown in 6A. Since there is a circuit 18 to control the load resistor 17 connection times the two waveforms 6A and 6C are not the same. The AC waveform that appears on the load resistor in FIG. 6C, 45 and 46 reduces the power dissipated by the load resistor by 50%. A 1.0K resistor would consume and dissipate 7.2 watts at 120 VAC. This additional 1.0 ohm resistive load would stabilize the LED dimming but 7 watts is for too much power to dissipate in a single in a single gang wall box with a dimmer switch.

In FIG. 7A is shown a normal 90% ON AC waveform 40 coming from a dimmer. It shows the usual points of falling zero crossing 42, rising zero crossing, 41 triac turn-on points 43, 44. In addition FIG. 7A shows the intersection of a +68V reference line 73 with the AC cycle at points 61, 62 and also FIG. 7A shows the intersection of a −68V reference line 74 with the AC cycle at points 63, 64. These four reference points, 61, 62, 63, and 64 can be used to establish timing points in FIG. 7B 65, 66, 67 and 68, so that the resistor load control circuit 18 can turn ON the load resistor at sections 57 and 59 and turn OFF the load resistor at section 58. Note that between the times 68 and 65 and again between times 66 and 67 the load resistor is turned OFF and the load resistor will be dissipating no power. The only time the load resistor will dissipate power is during the ON times shown as 75, 76, 77, and 78 in FIG. 7C. These sections 75, 76, 77, and 78 are when the load resistor is needed most to stabilize the dimming. When the AC voltage is high during periods 58 the triac in the dimmer is almost fully on so extra stabilizing resistance is not needed.

The normal waveform at 90% brightness is shown in 6A. Since there is a circuit 18 to control the load resistor 17 connection times the two waveforms are not the same. A 1.0K resistor inserted into the load circuit at the times 75, 76, 77, 78 shown in FIG. 7C would consume and dissipate only 1.0 watts at 120 VAC. This is the fundamental advantage presented in this application. The relatively small load resistor, here shown as 1 ohm 17 in FIG. 3, can be inserted into the AC cycle only at the times 57, 59 and the dimmer problems will be resolved allowing the dimmer to correctly turn on and off the load. The problems which were caused by the LED will be resolved by the insertion of the 1.0 ohm resistor 17 load when the voltage is low nearest to the zero crossing points. 41, 42. Also note that during the on periods 57 and 59 the AC voltage is very low, thereby dissipating much less power in the resistor since the power equation for a resistor is $V^2/R$. If the voltage below the +68V, 73 and above the −68V, 74 line is about 1.2 of the peak voltage the power dissipated is only ¼ of the peak power since the square factor in the equation.

FIG. 8A shows the usual points of falling zero crossing 42, rising zero crossing, 41 triac turn-on points 43, 44. FIG. 8A shows a conventional triac-based dimming waveform 60 with FIG. 7A at 90% brightness after being rectified with a full-wave bridge rectifier diode bridge 18 in FIGS. 9, 10, and 11. This is important because it is much simpler to design and build a control circuit that only must control positive voltages as shown in FIGS. 8A and 8C than to control voltages that go both positive and negative as shown in FIGS. 7A and 7C. As will be illustrated later in FIGS. 9, 10, and 11 simple inexpensive transistors and zener diodes can be used to build the control circuits 18, 20. The fact that the waveforms are rectified does not change the power that would be dissipated by a load resistor 7 but the fact that the waves are rectified makes them simpler and less expensive to control the waveforms since they are all DC instead of AC. DC signals can be controlled with simple inexpensive bipolar transistors where AC signals would need to be controlled with MOSFETs, FETs, or triacs. The load resistor control concept for the preferred embodiment of this application is very straightforward. If the voltage level of the waveform is above some preset level, say 68V, the load resistor is disconnected. If the dim level is below some preset level, y 68V, the load resistor is connected. FIG. 8B shows the same timing waveforms and timing points 61, 62, 63, and 64 and periods 68, 65, 66, and 67 as FIG. 7B. These timing points are the point where the voltage goes above 61 or below 62 68V as shown at 73. FIG. 8C shows the same waveform as in FIG. 7C except after being rectified the waveform is positive instead of positive and negative. This waveform FIG. 7C is the only voltage that reaches the load resistor. Even with a 1.0 ohm resistor 17 as shown in FIG. 3, the resistor will only dissipate about 1 watt with the modified waveform as shown in FIG. 8C. The timings of the waveform sections 75, 76, 77, and 78 are determined by the 68V crossing points 61, and 62.

Figure 9:
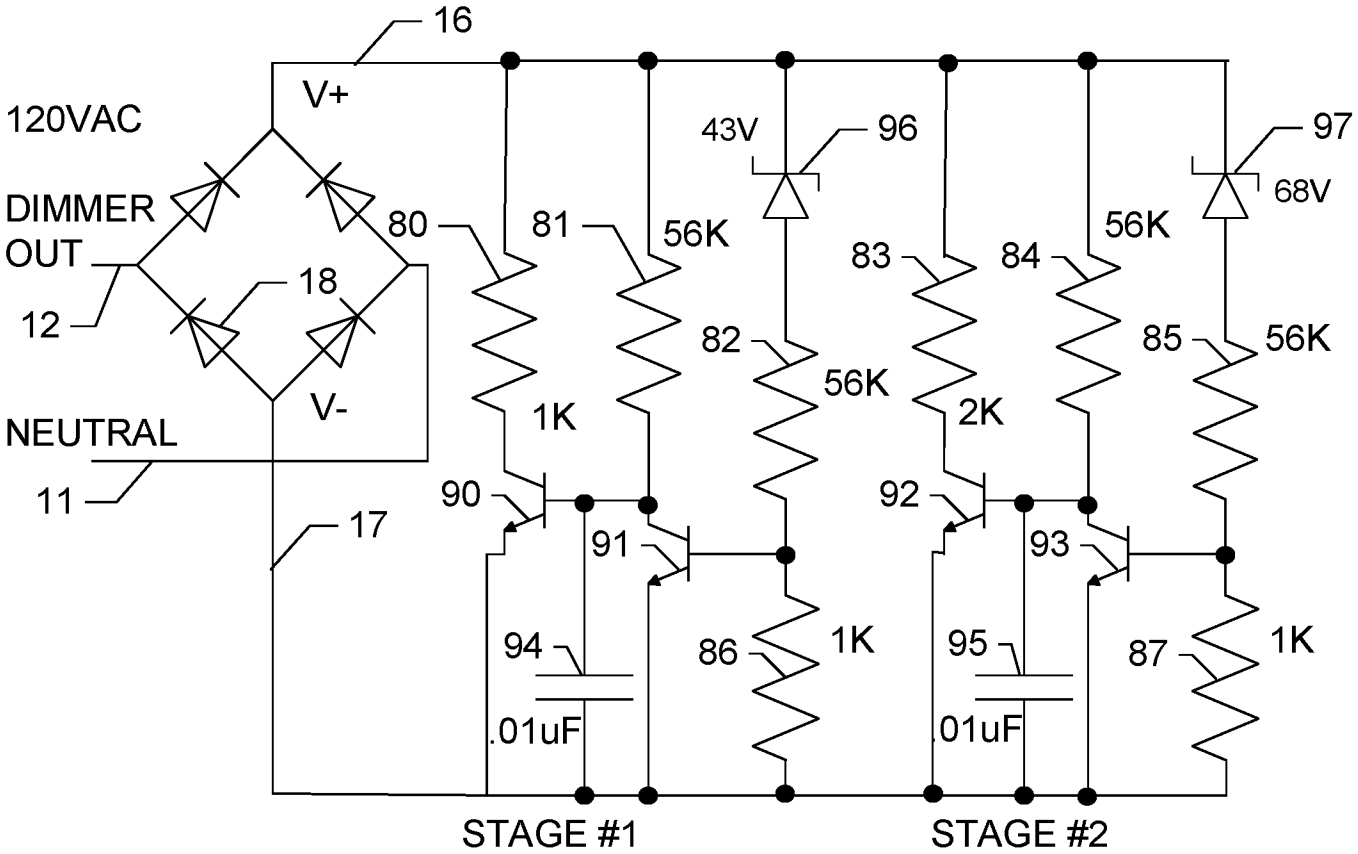
FIG. 9 ZERO CROSSING METHOD CIRCUIT. This figure shows one possible circuit that could be used to limit the load resistor insertion time to some fixed time before and after the zero crossing points.

FIG. 9 shows a circuit that will connect a load resistor 17 across a dimmer output 12 only when the dimmer voltage is above a certain fixed level. Note that the circuit shown in FIG. 9 is the preferred embodiment of the application. There are two stages of the circuit shown that have different trigger levels. Stage 1 is shown with the components to the left using the 43V zener diode 96 and stage 2 uses the 68V zener diode 97. The two stages have different trigger levels, 43V and 68V but aside from the trigger levels operate identically. This description will be limited to the description of stage 1.

Figure 8:
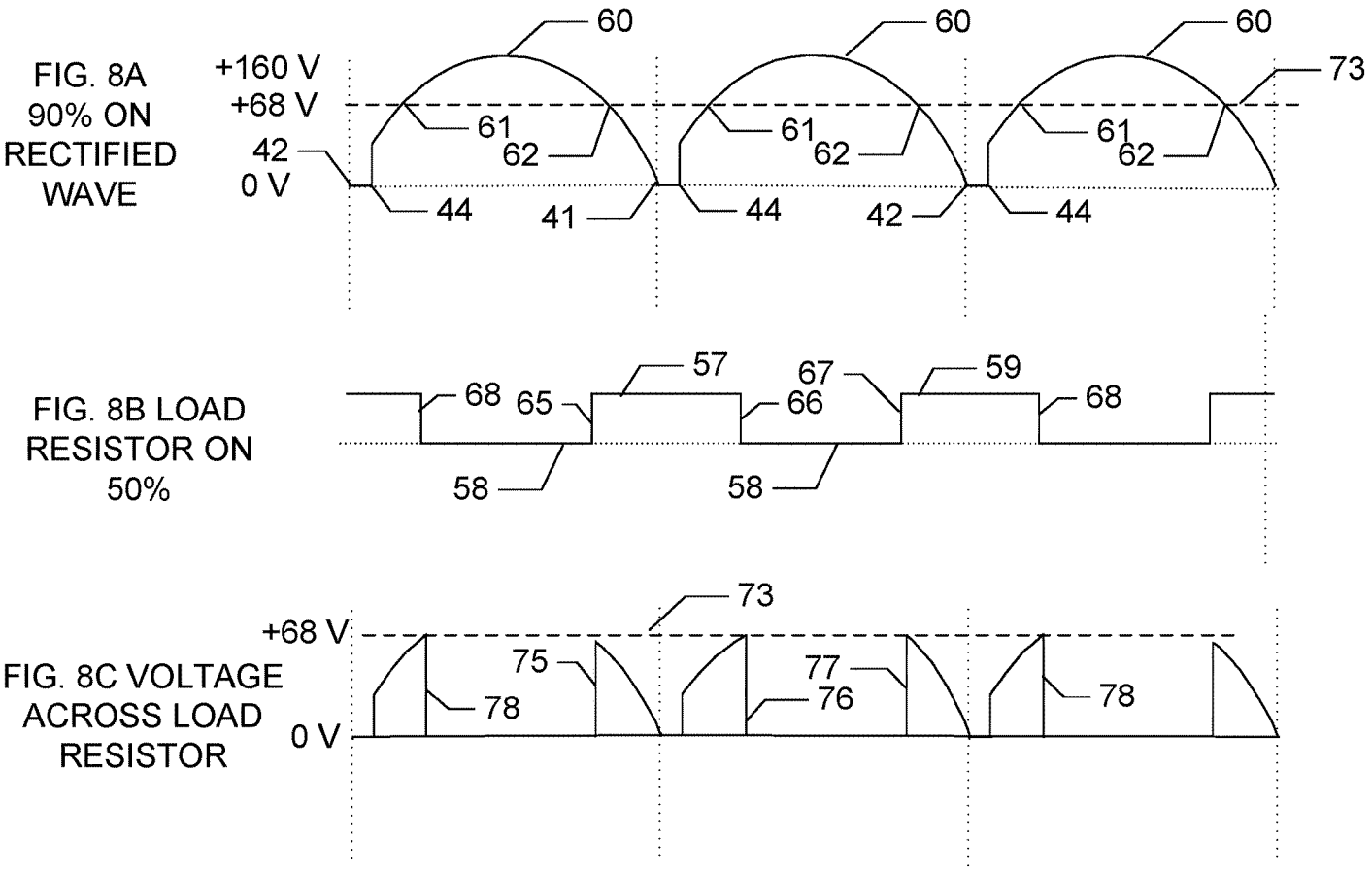
FIG. 8 DIMMING WAVEFORM RECTIFIED, DIM LEVEL METHOD. This figure shows the diagram a conventional triac-based dimming waveform, after being rectified, with the dimmer set to 100%, 50% and 10%. This figure also shows the voltage waveform that would be imposed across a fixed simple load resistor such as the one shown in FIG. 2 except this figure also shows the power that would be dissipated across a load resistor that is ONLY inserted into the circuit if the dim level is 50% or below. In this example if the dim level is set to 100% the power dissipated by the load resistor is 0.0 watts and when the dim level is set to 50% the power dissipated by the load resistor is 7.2 watts and when dim level is set to 10% the power dissipated by the load resistor is 1.0 watt.

The bridge rectifier 18 converts the positive and negative waveforms of the voltage wave form to DC, positive only so that a simple transistor circuit can control both parts of the waveforms, as shown in FIG. 8. The transistor 90 can turn the current to the load resistor 80 on or off. As the initial voltage 16 is low, below 43V no current will flow through zener diode 96. Current will flow through resistor 81 turning on transistor Q1 100% enabling Q1 to saturate and connecting the primary 1K ohm load resistor 80 to be connected directly to the load line 16, and effectively connecting it to the dimmer output 12. The resistor 80 stays connected to the load line 16 until the sine wave voltage rises to the zener diode 96 voltage of 43V. Capacitor 94 is connected at the base of transistor 90 to keep higher frequency noise pulses from effecting the circuit operation.

Every time the voltage 16 at V+ gets above the zener diode 96 voltage 43V, current flows through resistors 82 and 86 until the voltage on the base of transistor 91 rises and the transistor quickly turns on. The transistor 91 now pulls the base of transistor 90 low, thereby turning transistor 90 completely off. This effectively disconnects the load resistor 80 from the circuit. Resistor 81 is a pullup resistor that was supplying current the base of the transistor 90, but as soon as the resistor 81 is shorted to ground by transistor 91 it can no longer turn on transistor 90.

The components show in Stage #2, 83, 84, 85, 87, 97, 92, 93, 95, of the circuit are similar to the components of Stage #1 except with a different zener diode 97 value of 68V, and different load resistor 83 value of 2K. The reason for having two different stages is that there can be two different load resistor values. In this example load resistor of Stage 1 is 1.0K and the load resistor for Stage #2 is 2.0K. Because the 2.0K load resistor is a larger value than the 1.0K load resistor it can be inserted into the circuit for a longer time and at a higher voltage and still dissipate the same amount of power. The reason to do this is to increase stability of the dimmer triac in the dimmer that controls the voltage to the LED for a longer period in the powerline cycle. As the waveform gets close to zero crossing first the higher value load resistor 81 2K is turned on and then some time later when the voltage is lower the lower value load resistor 80 1K can be turned on. In this manner the pair of resistors can cover a larger portion of the powerline cycle. Resistor 80 can be chosen to use the same average power as resistor 81 even though it has a lower value. This is true because of two reasons, one, because it is inserted for a shorter time near zero crossing, and two because the voltage of the waveform is much lower close to zero crossing. This allows us to choose a lower resistor value for 80 and have a much more stabilizing effect, since the lower the value the better the stabilizing effect.

To summarize the operation of this circuit, the values of the zener diodes determine when the load resistors are connected and disconnected from the dimmer output lines. Since LEDs dimming problems are most frequently present at low dim levels this circuit allows the load resistors to be inserted to stabilize the dimmer but the resistors are only inserted at the lower powerline voltages which are present at the same time periods as the lower LED dim levels.

Note that this circuit connects and disconnects the load resistors in real time with effectively no delays during the powerline cycle as the voltage goes up and down. Within microseconds of the voltage going above or below the zener diode voltage levels the load resistors are turned on and off. Each load resistor, 80, 83 is quickly turned on and off four times in every AC ½ cycle as shown in FIG. 8C.

Figure 10:
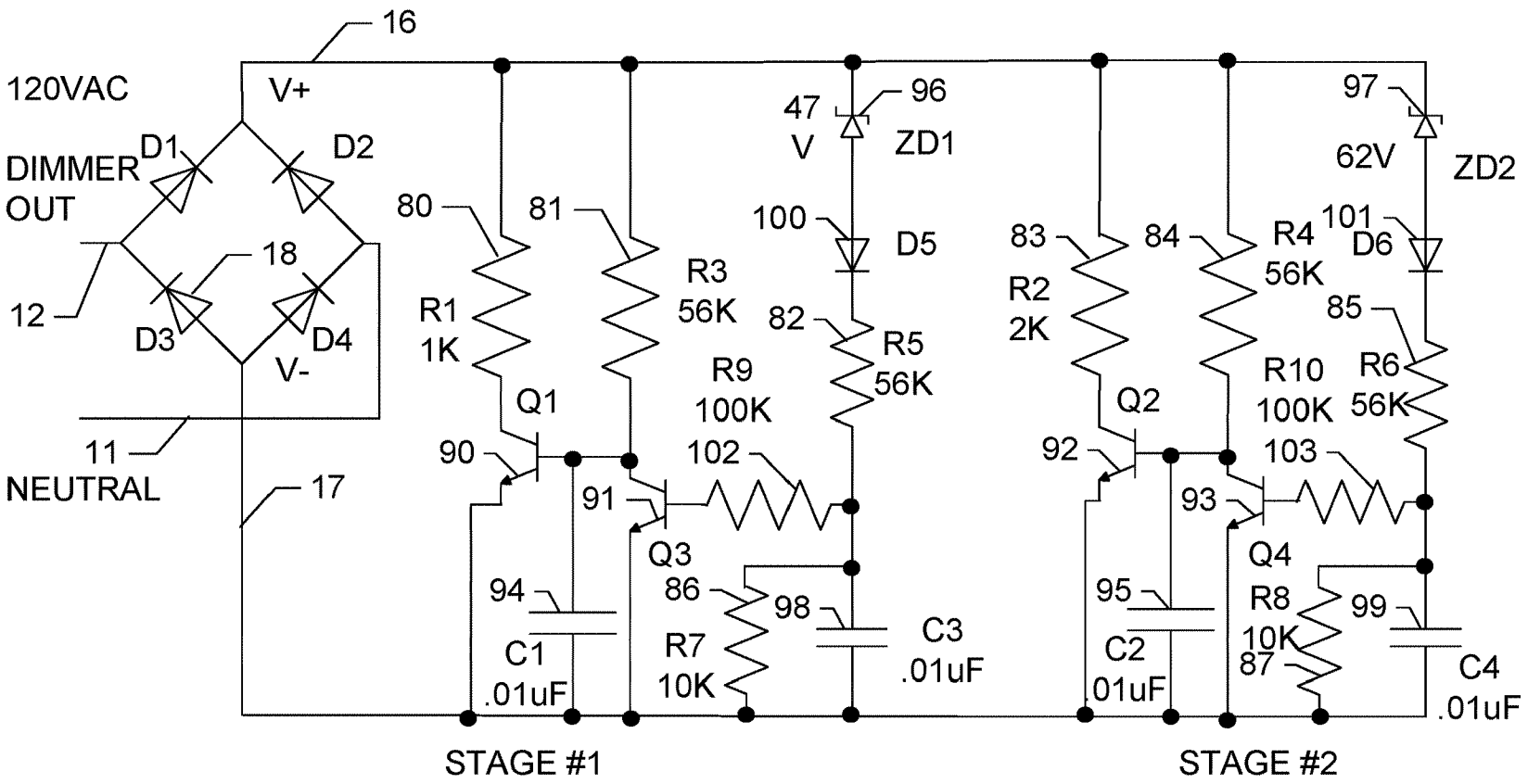
FIG. 10 DIM LEVEL METHOD CIRCUIT This figure shows one possible circuit that could be used to limit the load resistor insertion to only when the average dim level is below some fixed value such as 30% or 50%.

The circuit in FIG. 10 uses a different approach and uses the average dim level to control the connection of the load resistors on a continuous basis over many powerline cycles as the dimmer is turned up and down. This is a different approach but is not the preferred embodiment of this application.

FIG. 10 shows a circuit that is almost identical to the circuit of FIG. 8 except for the addition of diodes 100, 101 and capacitors 98, 99. These capacitors charge up to keep an average voltage available to keep transistors 91 and 93 on and in turn transistors 90 and 92 off, effectively disconnecting the load resistors 81 and 83 when the overall average dimmer voltage 17 gets to a predetermined high level. The capacitors C3, C4 and resistors 86, 87 can be chosen to determine the overall time constant that determines how fast or slow the load resistors 80, 83 are connected and disconnected from the dimmer.

The components such as the zener diodes 96 and 97 can be chosen so that the load resistors are only connected when the dimmer voltage is below some predetermined level. For example the larger load resistor 83 which is 2K can be inserted when the dimmer is below 30% and the smaller load resistor 81 which is 1K can be inserted when the dim level is below 15%. This way the total power dissipated by the dimming stabilizing device can be kept at a safe low level of less than 2 watts yet the maximum stabilizing effect of the dimmer triac can be achieved.

Figure 11:
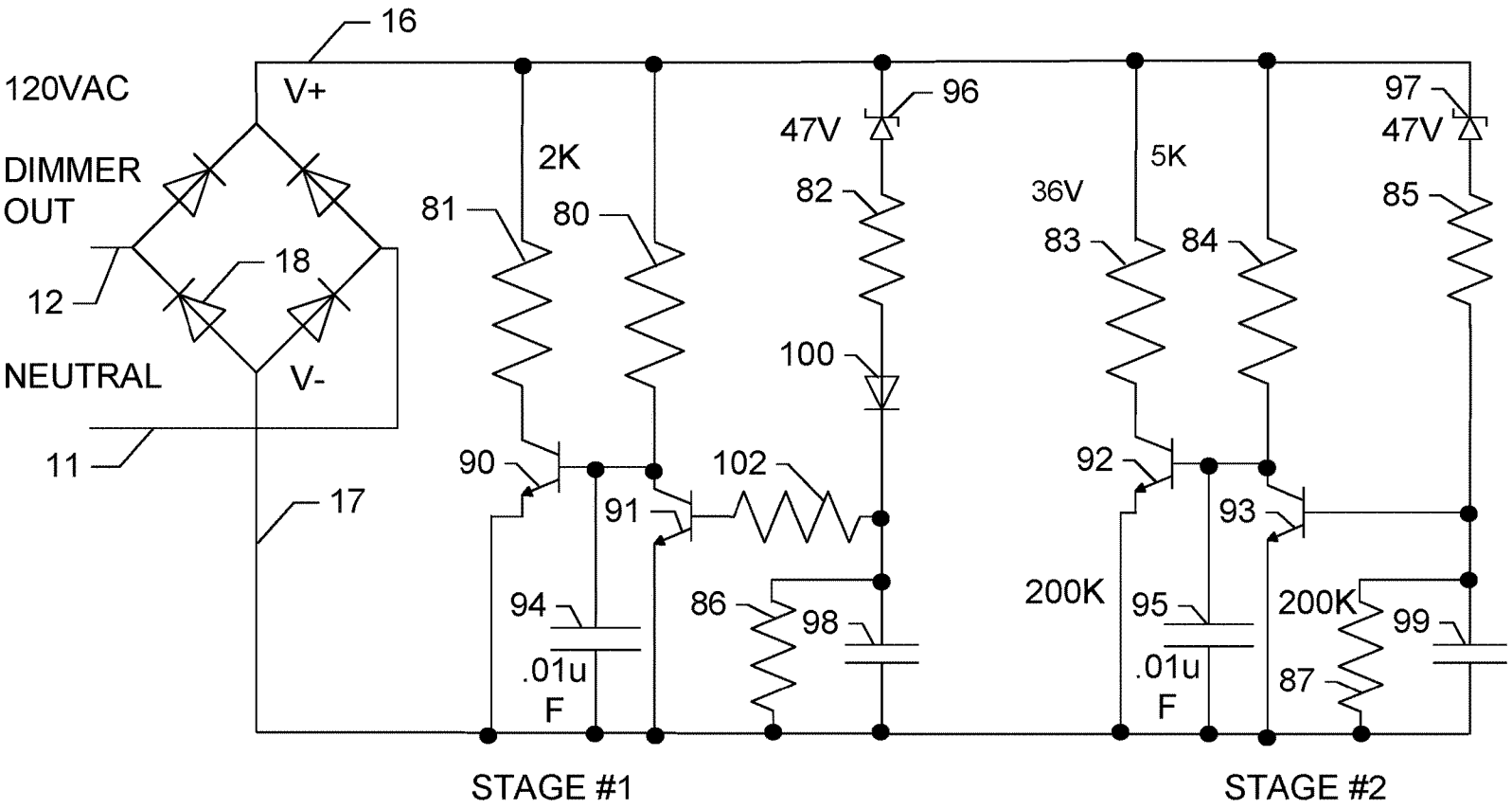
FIG. 11 COMBINATION DIM-LEVEL AND ZERO CROSSING CIRCUIT. This figure shows a circuit that combines two separate circuits, one of the dim method and one of the zero crossing method.

FIG. 11 shows how both types of circuits shown in FIG. 8 and FIG. 9 can be combined in one circuit as two different stages in order to take advantages of the effects of both methods. In fact several stages of each type of circuit can be combined into one large circuit since the cost of the components is very low.

Figure 12:
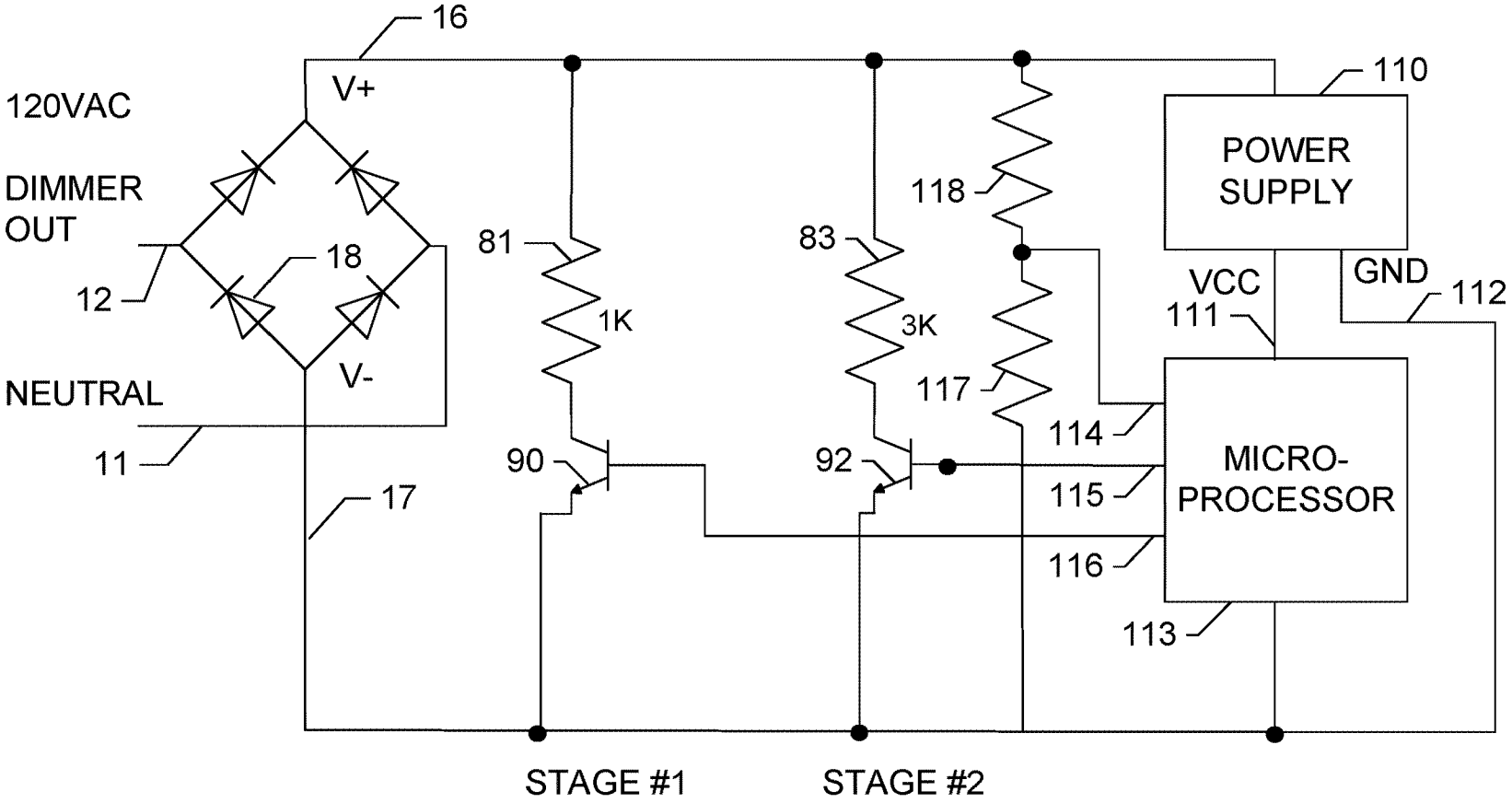
FIG. 12 MICROPROCESSOR CONTROL This figure shows a block diagram of how a microprocessor can be used to implement the control of the load resistors.

FIG. 12 shows how an inexpensive microprocessor 113 can be used to control the load resistors. In this circuit a conventional power supply 110 produced the correct voltages 111, 112 for the microprocessor 113. A simple voltage divider is made with resistors 117 and 118 and connected to an A/D input 114 of the microprocessor 113. By continuously monitor the dimmer voltage on this input 114 the processor can know how low or high the dimmer output voltage is set to and where the zero crossings are in the powerline cycle. Different algorithms can be used to turn On and Off different load resistors. In this example there are only two different load resistors 81 and 83, controlled by the microprocessor through outputs 115, and 116 but there could be more so that the microprocessor can have finer control of the total load inserted into the dimmer circuit.

Figure 13:
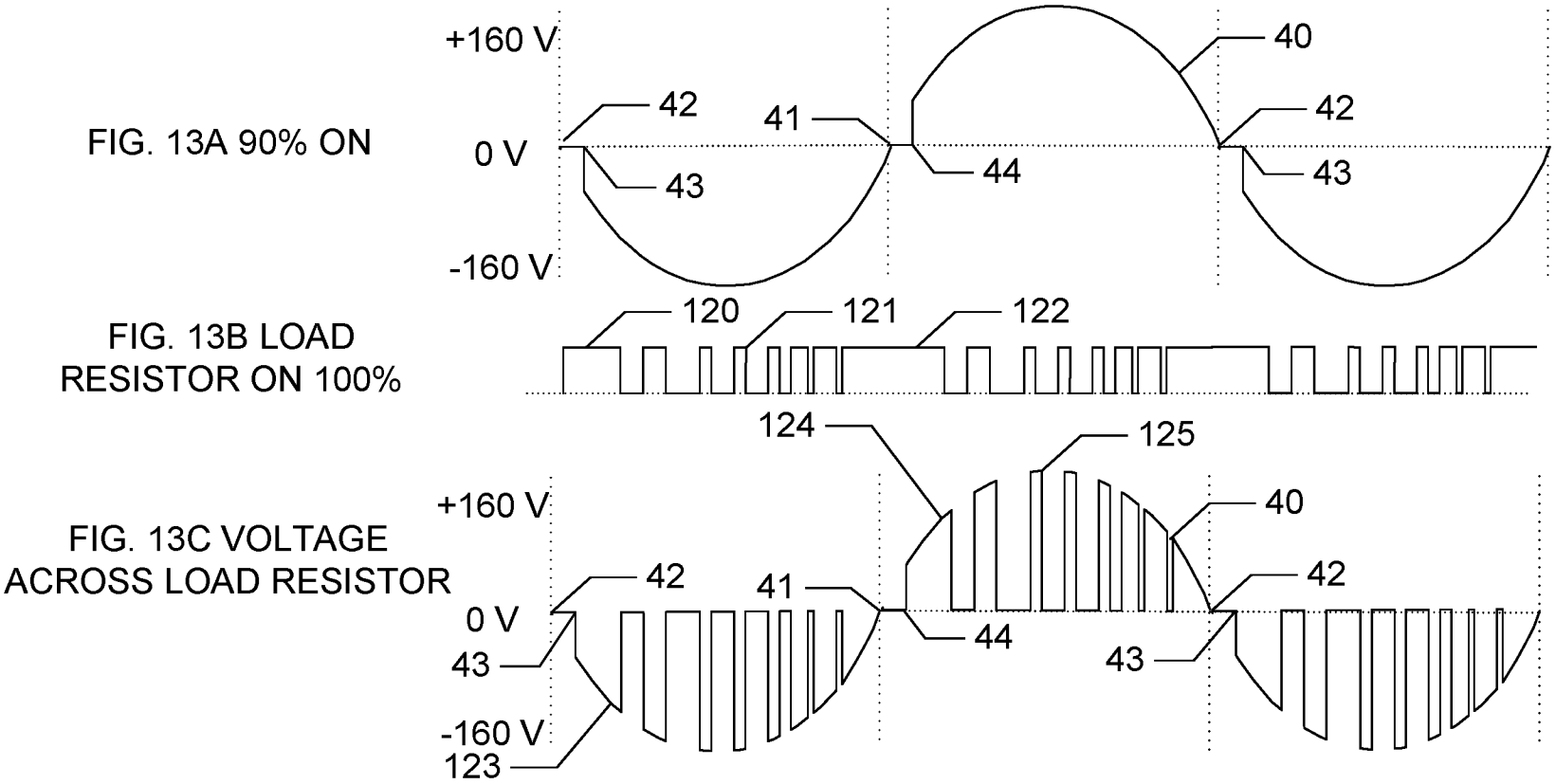
FIG. 13 PWM METHOD This figure shows how a PWM method can be used to reduce the power and control of the load resistors.

FIG. 13 shows how a form of variable Pulse Width Modulation can be used to turn a load resistor on and off at some chosen frequency. This would be simple to do with the microprocessor circuit of FIG. 1. The modulated turning of the load resistor can have two positive benefits. One benefit is that the overall power dissipated by the load resistor can be easily controlled by varying the duty cycle of the PWM. And two, the stabilizing effect can be increased by keeping the triac in the dimmer correctly trigged by re-triggering it so quickly that any short turn-off periods will be invisible to the human eye. FIG. 13B shows a possible PWM signal that could be output from a microprocessor to control a load resistor. FIG. 13C shows the resulting waveform that appears across the load resistor.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A load control system comprising:

a. an electrical system with a AC line supply and a AC neutral supply, and b. a dimmer having an input connection to said AC line supply and a dimmer load output connection, and c. one or more LED lights each having a first connection to said dimmer load output connection and a second connection to said AC neutral supply, and d. a dimming stabilizing device with a connection to said dimmer load output connection and a connection to said AC neutral supply, and e. said dimming stabilizing device incorporating an electrical control circuit, and f. said electrical control circuit including one or more switch devices in series with one or more resistive loads, g. said electrical control circuit capable of connecting and disconnecting said one or more resistive loads repetitively to said dimmer load output connection and said AC neutral supply for one or more predetermined time periods that are each a fraction of the nominal total AC cycle time, and h. The said fraction of the nominal AC cycle time determined by when average output voltage level on said dimmer load output connection is set below a predetermined average voltage level, whereby said dimming stabilizing device effectively inserts said resistive loads in parallel with the said LED lights at parts of the AC waveform where the insertion is most effective to enable said dimmer output circuits produce a correct dimming waveforms that enable the electronic circuits in LED drivers operate and dim correctly.

2. The said fraction of the nominal total AC cycle time of claim 1 determined by when the instantaneous output voltage level on said dimmer load output connection is below a predetermined instantaneous voltage level.

3. The said one or more LED lights of claim 1 where said one or more LED lights are LED fixtures incorporating both LED lights and LED drivers.

4. The said one or more LED lights of claim 1 where said one or more LED lights are LED screw-in bulbs incorporating both LED lights and LED driver.

5. The said fraction of the nominal total AC cycle time of claim 1 where said one or more resistive loads are only applied only during those parts of the powerline cycle before and after zero crossing but not during the period when powerline voltage is at or near the peak AC voltage.

6. The said dimmer of claim 1 where said dimmer is in the form of a conventional wall box dimmer.

7. The said one or more switch devices of claim 1 where said switch devices are triacs, transistors, FETs, or MOSFETs.

8. The said electrical control circuit of claim 1 including a rectifier to change the said dimmer output wave form within said electrical control circuit from an AC signal with both positive and negative voltages into a DC signal with positive voltages only.

9. A dimming stabilizing device comprising:

a. a first input connection to a dimmer load output wire, b. a second input connection to a AC system neutral wire, c. an electrical control circuit including one or more switch devices in series with one or more resistive loads, d. said electrical control circuit capable of electrically connecting said one or more resistive loads between said first and second input connections repetitively for one or more predetermined time periods that are each a fraction of the total AC power cycle time period, and e. the said one or more predetermined time periods where said time periods are determined as a function of the average AC voltage on said dimmer load output wire.

10. The one or more switch devices of claim 9 where said switch devices are triacs, transistors, FETs, or MOSFETs.

11. The one or more predetermined time periods of claim 9 where said time periods are at parts of the AC waveform near zero crossing and not near the parts of the center of the AC waveform where the AC voltage is at the highest voltage.

12. The one or more predetermined time periods of claim 9 where said time periods are determined as a function of the instantaneous AC voltage on the said dimmer load output wire.

* * * * *